United States Patent [19]

Lee

[11] Patent Number: 4,558,290

[45] Date of Patent: Dec. 10, 1985

[54] COMPACT BROADBAND RECTANGULAR TO COAXIAL WAVEGUIDE JUNCTION

[75] Inventor: Joseph C. Lee, Lexington, Mass.

[73] Assignee: The United States of America as represented by the Secretary of the Air Force, Washington, D.C.

[21] Appl. No.: 598,949

[22] Filed: Apr. 11, 1984

[51] Int. Cl.[4] ..... H01P 5/12; H01P 1/16

[52] U.S. Cl. ..... 333/126; 333/21 R; 333/33

[58] Field of Search ..... 333/21 R, 26, 33, 117, 333/122, 126, 135

[56] References Cited

U.S. PATENT DOCUMENTS

| | | | |
|---|---|---|---|
| 2,682,610 | 6/1954 | King . | |
| 3,004,228 | 10/1961 | Fogel . | |
| 3,036,279 | 5/1962 | Heeren et al. . | |
| 3,508,277 | 4/1970 | Ware et al. | 333/21 R X |
| 3,594,663 | 7/1971 | Allen . | |
| 3,922,621 | 11/1975 | Gruner | 333/21 R X |
| 4,298,850 | 11/1981 | Pellerin et al. . | |
| 4,353,041 | 10/1982 | Bryans et al. . | |

OTHER PUBLICATIONS

M. L. Livingston, "Multi-Frequency Coaxial Cavity Apex Feeds", *Microwave Journal* (Oct. 1979) pp. 51–53.

E. Malowicki, "Coaxial Cavity Radiator", *IEEE Transactions on Antennas and Propagation* (Sep. 1969) pp. 637–640.

A. E. Williams and F. L. Frey, "A Dual-Polarized 5-Frequency Feed", *National Tele-Communication Conf.*, (1976) pp. 494–1, 494–2.

E. A. Ohm, "A Broad-Band Microwave Circulator", *IEEE Transactions on Microwave Theory and Techniques* (Oct. 1956) pp. 210–217.

I. R. Ravenscraft, "Primary Feeds for the Goonhilly Satellite-Communication Aerial", *NASA SP*-32, 4 (Dec. 1965) pp. 2141–2155.

A. F. Sciambi, "Five-Horn Feed Improves Monopulse Performance", *Microwaves*, (Jun. 1972) pp. 56–58.

*Primary Examiner*—Paul Gansler

*Attorney, Agent, or Firm*—Donald J. Singer; Richard J. Donahue

[57] ABSTRACT

A compact waveguide junction for coupling rectangular waveguide of one frequency band to a coaxial waveguide, and a second rectangular waveguide of a second frequency band to the interior of the hollow center conductor of the coaxial waveguide.

11 Claims, 4 Drawing Figures

COMPACT BROADBAND RECTANGULAR TO COAXIAL WAVEGUIDE JUNCTION

STATEMENT OF GOVERNMENT INTEREST

The invention described herein may be manufactured and used by or for the Government for governmental purposes without the payment of any royalty thereon.

BACKGROUND OF THE INVENTION

The present invention concerns a compact broadband rectangular to coaxial waveguide junction. More particularly, it concerns apparatus for transducing the $TE_{10}$ mode in rectangular waveguide to the $TE_{11}$ mode in a combined circular-coaxial waveguide.

A need exists for an improved means for coupling electromagnetic energy in a rectangular waveguide to a circular coaxial waveguide. It is especially needed in dual or multiband waveguide systems which utilize microwave components such as dual or multiband feeds, multiplexers and multi-channel rotary joints.

One known type of microwave waveguide transducer utilizes TEM coaxial line probes and is described in the following publications:

(1) M. L. Livingston, "Multi-frequency Coaxial Cavity Apex Feeds", *Microwave Journal* (October 1979) pp 51–53.

(2) E. Malowicki, "Coaxial Cavity Radiator", *IEEE Transactions on Antennas and Propagation* (September 1969) pp 637–640.

(3) A. E. Williams and F. L. Frey, "A Dual-Polarized 5-Frequency Feed", *National Tele-communication Conf.* (1976) pp 494-1, 494-2.

The aforementioned coaxial probe devices are lossy at the higher microwave frequencies and also require tight control of mechanical tolerances in their fabrication. Therefore they are limited to applications in the lower microwave frequency bands.

Another known type of microwave transducer couples rectangular to circular waveguides through resonant irises. This concept can be conceivably extended to coaxial waveguide by adding a center conductor. Examples of iris type transducers without a center conductor are described in the following publication and patents:

(4) E. A. Ohm, "A Broad-band Microwave Circulator", *IEEE Transactions on Microwave Theory and Techniques* (October 1956) pp 210–217.

(5) U.S. Pat. No. 3,004,228 entitled "Orthogonal Mode Transducer", issued Oct. 10, 1961 to R. L. Fogel.

(6) U.S. Pat. No. 2,682,610 entitled "Selective Mode Transducer", issued June 29, 1954 to A. P. King.

Such devices using coupling irises generally require tight control of mechanical tolerances and are relatively narrow band with low power handling capacity.

Still another known type microwave transducer device for coupling rectangular to circular waveguide employs shorted metal fins with tapering thickness, such as disclosed in the following publication:

(7) I. R. Ravenscraft, "Primary Feeds for the Goonhilly Satellite-Communication Aerial", *NASA SP*-32, 4 (December 1965) pp 2141–2155.

Yet another known microwave transducer device utilizes turnstyle junctions, as discussed in the following publication:

(8) A. F. Sciambi, "Five-Horn Feed Improves Monopulse Performance", *Microwaves,* (June 1972) pp 56–58.

Shorted metal fin and turnstyle designs as disclosed above require rather long physical length and are expensive to fabricate.

SUMMARY OF THE INVENTION

It is therefore the primary object of the present invention to provide a waveguide junction that can couple oen rectangular waveguide of one frequency band to a coaxial waveguide and a second rectangular waveguide of a second frequency band to the interior of the hollow center conductor of the coaxial waveguide.

It is an additional object of the present invention to provide an improved waveguide junction for coupling a single rectangular waveguide of one frequency band to a coaxial waveguide.

It is another object of the present invention to provide a rectangular to coaxial waveguide junction that is physically small in size and of lower loss than existing transducers.

It is another object of the present invention to provide a rectangular to coaxial waveguide junction that is easy to fabricate and therefore less expensive than known rectangular to coaxial waveguide transducers.

It is a further object of the present invention to provide a rectangular to coaxial waveguide junction that is less critical of mechanical tolerances than known rectangular to coaxial waveguide transducers.

It is yet another object of the present invention to provide a rectangular to coaxial waveguide junction that is capable of broadband operation.

It is still another object of the present invention to provide a rectangular to coaxial waveguide junction that does not require adjustable tuning elements.

These and other objects of the invention are achieved by combining the functions of 90° waveguide H-plane bends, a $TE_{10}$ rectangular mode to $TE_{11}$ circular mode transducer and a circular waveguide to coaxial waveguide transducer, all in a novel compact junction. Physically, the waveguide junction is formed by orthogonally attaching the lower frequency rectangular waveguide to the outer tube of the coaxial waveguide, by orthogonally coupling the higher frequency rectangular waveguide through the outer tube of the coaxial waveguide to the interior of the hollow inner conductor of the coaxial waveguide, and by providing a stepped impedance matching shorting member in the active junction area.

These and other advantages, objects and features of the invention will become more apparent after considering the following description taken in conjunction with the illustrative embodiment in the accompanying drawings.

DETAILED DESCRIPTION OF THE INVENTION

Figure 1B:
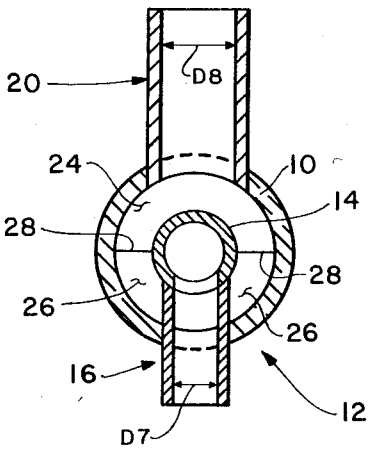
FIG. 1B is an end elevation view of the present invention taken thru the line A—A of FIG. 1A.
Figure 1C:
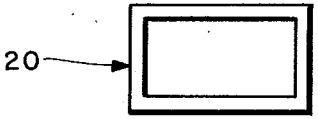
FIGS. 1C and 1D are end views of the low and high frequency rectangular waveguides of the dual frequency embodiment of the present invention.
Figure 1A:
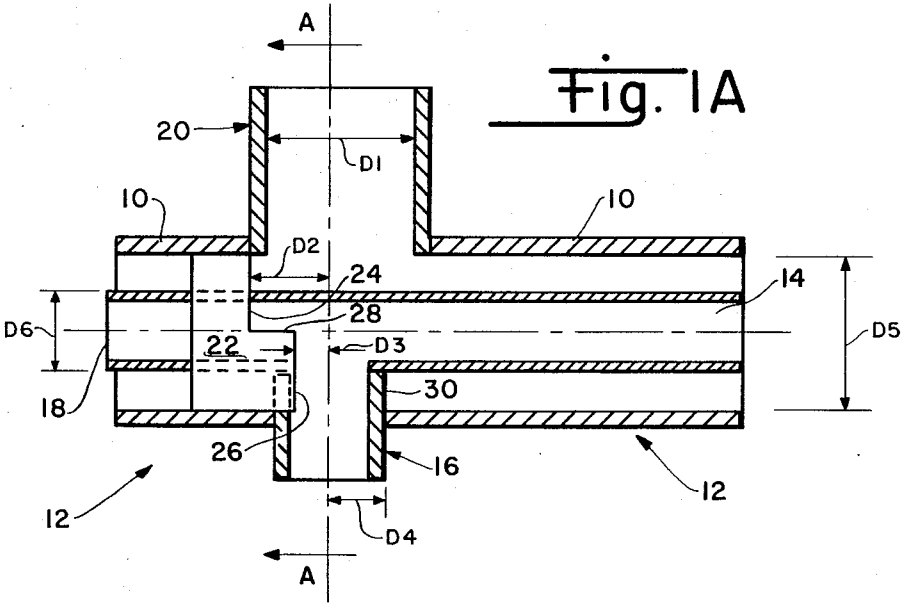
FIG. 1A is a partially cut away plan view of the waveguide junction of the present invention.
Figure 1D:
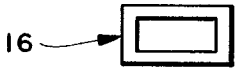

Referring now to the drawings, the side view of the waveguide junction depicted in FIG. 1A has been partially cut away to better show the internal structure of the junction. Specifically, the walls of the outer tube 10, hollow inner conductor 14 and rectangular waveguides 16 and 20 have been cut away in the drawing while the internal shorting member 22 is depicted in its entirety. A few internal lines in the drawing have been purposely omitted for clarity of the invention. Coaxial waveguide 12 has been cut away to expose the hollow inner conductor 14 of the coaxial waveguide 12. The inner conductor 14 has the proper internal dimensions to carry microwave signals to and from high frequency rectangular waveguide 16.

It will be seen that rectangular waveguide 16 protrudes through the outer tube 10 and is terminated as it enters the hollow inner conductor 14. If required, an impedance matching septum may be inserted within conductor 14, and the end 18 of inner conductor 14 may be closed by a shorting plug or resistive termination. Various impedance matching devices for rectangular to circular waveguide, and terminations for circular waveguide are well known by practitioners of this art and therefore have been omitted herein to simplify and clarify the drawings.

A second rectangular waveguide 20 for coupling microwave energy of a lower frequency is positioned at the outer wall 10 of coaxial waveguide 12, diametrically opposite waveguide 16. Both rectangular waveguides 16 and 20 have their larger cross-sectional dimension parallel to the major axis of coaxial waveguide 12 to effectively form 90° H-plane bends.

An impedance matching shorting member 22 is positioned within the coaxial waveguide 12 between its inner conductor 14 and its outer conductor 10. Member 22 has a hollow cylindrical shape which fills the space between the inner and outer conductors of coaxial waveguide 12. One end of member 22 is stepped in the vicinity of waveguide 20, forming vertical surfaces 24 and 26 separated by horizontal step 28 at the major axis of coaxial waveguide 12. The end view of member 22 is seen in FIG. 1B of the drawings.

The waveguide junction described above is adapted to propagate microwave signals in the $TE_{10}$ mode in the rectangular waveguides to signals in the $TE_{11}$ mode in the coaxial waveguide and in the circular waveguide formed by its hollow center conductor.

A waveguide junction has been constructed in accordance with the embodiment described above to couple X-band and K-band microwave energy to the circular coaxial waveguide, and had the following dimensions designated in the drawings.

| Designation | Dimension (inches) | Dimension (center frequency free space wavelength) |
|---|---|---|
| D1 | .900 | .724 |
| D2 | .466 | .375 |
| D3 | .160 | .129 |
| D4 | .324 | .261 |
| D5 | .938 | .755 |
| D6 | .466 | .375 |
| D7 | .401 | .331 |
| D8 | .364 | .298 |

It will be apparent that similar devices can be constructed for other frequency bands by referring to the fractional wavelength dimensions given above and calculating the new physical dimensions therefrom.

The bandwidth of the disclosed waveguide junction was measured, and the measured return loss was found to be greater than 20 dB over 8 to 10 GHz (VSWR $\leqq 1.22$, mismatch loss $\leqq 0.05$ dB). Over the bandwidth of 7.5 to 12.4 GHz, wider than WR-90 waveguide bandwidth, (8.2 to 12.4 GHz), the return loss was greater than 16 dB (VSWR $\leqq 1.38$, mismatch loss $\leqq 0.12$ dB).

The junction has a plane of symmetry bisecting the narrow sides of the rectangular waveguides and passing through the axis of the coaxial circular waveguide. This symmetry guarantees that negligible energy in the TEM mode will be generated at the junction.

This junction design has also been successfully implemented in a compact dual frequency (K- and Q-band) feed design. Radiation pattern measurements show that the TEM mode is not noticeably excited. The lower frequency limit of operation is set by the cut-off frequency of the larger dimensioned rectangular waveguide 20. The high frequency limit is set by the cut-in frequency of a higher mode in the coaxial circular waveguide.

Although the invention has been described with reference to a particular embodiment, it will be understood to those skilled in the art that the invention is capable of a variety of alternative embodiments within the spirit and scope of the appended claims. For example, it is possible to close off the port for the higher frequency waveguide and use the device as an improved means for transducing a single microwave frequency from the rectangular $TE_{10}$ to coaxial $TE_{11}$ mode. Also, it is possible for the higher frequency band to add a conductor within the hollow inner conductor 14 to provide a dual rectangular to dual coaxial transducer. In this case, the shorting member 22 and the wall 30 of waveguide 16 will be repeated within the inner conductor 14.

It will also be obvious to those acquainted with this art that the circularly-shaped waveguide can be replaced with other coaxial shapes, such as for example square and hexagonal waveguide.

What is claimed is:

1. A waveguide junction for coupling electromagnetic energy from two separate rectangular waveguides into a combined circular coaxial waveguide, and from the circular coaxial waveguide into the two separate rectangular waveguides, comprising:

a coaxial waveguide adapted to carry electromagnetic waves of a first frequency band in the $TE_{11}$ mode;

a circular waveguide adapted to carry electromagnetic waves of a second frequency band in the $TE_{11}$ mode; said circular waveguide being contained within the hollow inner conductor of said coaxial waveguide, thereby forming a combined circular coaxial waveguide;

a first rectangular waveguide adapted to carry electromagnetic waves of said first frequency band positioned normal to the longitudinal axis of said circular coaxial waveguide and coupled to the outer wall thereof;

a second rectangular waveguide adapted to carry electromagnetic waves of said second frequency band positioned normal to the longitudinal axis of said circular coaxial waveguide and coupled through said outer wall to the wall of said hollow inner conductor of said circular coaxial waveguide diametrically opposite said first rectangular waveguide; and a shorting member positioned at one end of said circular coaxial waveguide enclosing the space between said inner conductor and said outer wall thereof; said shorting member having an end thereof with a step formed at the major axis of said circular coaxial waveguide adjacent the junction of said first rectangular waveguide.

2. Apparatus as defined in claim 1 wherein said step is normal to the longitudinal axis of said first rectangular waveguide.

3. Apparatus as defined in claim 2 wherein said first rectangular waveguide has its larger side aligned with the longitudinal axis of said circular coaxial waveguide.

4. Apparatus as defined in claim 3 wherein said second rectangular waveguide has its larger side aligned with the longitudinal axis of said circular coaxial waveguide.

5. Apparatus as defined in claim 4 wherein said first rectangular waveguide terminates at the inner surface of said outer wall of said circular coaxial waveguide.

6. Apparatus as defined in claim 5 wherein said second rectangular waveguide extends through said outer wall of said circular coaxial waveguide and terminates at the inner surface of said inner conductor of said circular coaxial waveguide.

7. Apparatus as defined in claim 6 wherein said first rectangular waveguide is dimensioned to carry electromagnetic energy at X-band frequencies and said second rectangular waveguide is dimensioned to carry electromagnetic energy at K-band frequencies.

8. Apparatus as defined in claim 7 wherein said first rectangular waveguide is dimensioned to carry electromagnetic energy at K-band frequencies and said second rectangular waveguide is dimensioned to carry electromagnetic energy at Q-band frequencies.

9. A waveguide junction comprising:

a coaxial waveguide having a tubular outer conductor and a concentric inner conductor;

a rectangular waveguide orthogonally coupled to said outer conductor of said coaxial waveguide; and a shorting member disposed between said inner and said outer conductor of said coaxial waveguide, said shorting member having a planar step therein adjacent the junction of said coaxial waveguide and said rectangular waveguide, said step being normal to the longitudinal axis of said rectangular waveguide and parallel to the longitudinal axis of said coaxial waveguide, said shorting member completely filling the space between said inner conductor and said outer conductor of said coaxial waveguide on one side of said junction.

10. Apparatus as defined in claim 9 wherein said rectangular waveguide has its longer side disposed parallel to the longitudinal axis of said coaxial waveguide.

11. A waveguide junction for coupling electromagnetic energy from two separate rectangular waveguides into a dual coaxial waveguide, and from the dual coaxial waveguide into the two separate rectangular waveguides, comprising:

a first coaxial waveguide adapted to carry electromagnetic waves of a first frequency band in the $TE_{11}$ mode;

a second coaxial waveguide adapted to carry electromagnetic waves of a second frequency band in the $TE_{11}$ mode; said second coaxial waveguide having its center conductor contained within and coaxial with the hollow inner conductor of said first coaxial waveguide, thereby forming a dual coaxial waveguide;

a first rectangular waveguide adapted to carry electromagnetic waves of said first frequency band positioned normal to the longitudinal axis of said first coaxial waveguide and coupled to the outer wall thereof;

a second rectangular waveguide adapted to carry electromagnetic waves of said second frequency band positioned normal to the longitudinal axis of said first coaxial waveguide and coupled through said outer wall to the wall of said hollow inner conductor of said first coaxial waveguide diametrically opposite said first rectangular waveguide;

a first shorting member positioned at one end of said first coaxial waveguide enclosing the space between said inner conductor and said outer wall thereof; said shorting member having an end thereof with a step formed at the major axis of said first coaxial waveguide adjacent the junction of said first rectangular waveguide; and a second shorting member positioned at one end of said second coaxial waveguide enclosing the space between said center conductor of said second coaxial waveguide and said inner conductor of said first coaxial waveguide; said shorting member having an end thereof with a step formed at the major axis of said second coaxial waveguide adjacent the junction of said second rectangular waveguide.

* * * * *